US007306196B2

(12) United States Patent
Nakamura et al.

(10) Patent No.: US 7,306,196 B2
(45) Date of Patent: Dec. 11, 2007

(54) ELECTROMAGNETICALLY DRIVEN VALVE

(75) Inventors: Kiyoharu Nakamura, Seto (JP); Yutaka Sugie, Nishikamo-gun (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 3 days.

(21) Appl. No.: 11/442,338

(22) Filed: May 30, 2006

(65) Prior Publication Data

US 2006/0272602 A1 Dec. 7, 2006

(30) Foreign Application Priority Data

Jun. 1, 2005 (JP) ..... 2005-161610

(51) Int. Cl.
*F16K 31/02* (2006.01)

(52) U.S. Cl. ..... 251/129.09; 251/129.2; 123/90.11; 335/268; 335/276; 361/159; 361/160

(58) Field of Classification Search ..... 251/129.09, 251/129.1, 129.15, 129.16, 129.2; 335/266–268, 335/270, 275, 276; 361/159, 160; 123/90.11
See application file for complete search history.

(56) References Cited

U.S. PATENT DOCUMENTS

| | | | | |
|---|---|---|---|---|
| 4,682,574 | A * | 7/1987 | Kreuter | 251/129.1 |
| 4,719,882 | A * | 1/1988 | Kreuter | 251/129.1 |
| 5,076,221 | A * | 12/1991 | Kawamura | 123/90.11 |
| 5,131,624 | A * | 7/1992 | Kreuter et al. | 251/129.18 |
| 5,222,714 | A * | 6/1993 | Morinigo et al. | 251/129.1 |
| 5,692,463 | A * | 12/1997 | Liang et al. | 123/90.11 |
| 5,765,513 | A * | 6/1998 | Diehl et al. | 123/90.11 |
| 5,992,391 | A * | 11/1999 | Yamakado et al. | 251/129.1 |
| 6,453,855 | B1 * | 9/2002 | Di Lieto et al. | 251/129.1 |
| 6,481,396 | B2 * | 11/2002 | Stolk et al. | 251/129.09 |
| 6,516,758 | B1 | 2/2003 | Leiber | |
| 6,718,620 | B2 * | 4/2004 | Paasch et al. | 251/129.09 |
| 2003/0130764 | A1 * | 7/2003 | Haghgooie et al. | 361/159 |

FOREIGN PATENT DOCUMENTS

| | | |
|---|---|---|
| JP | 5-18220 | 1/1993 |
| JP | 5-106414 | 4/1993 |
| JP | 11-141319 | 5/1999 |
| JP | 2001-214764 | 8/2001 |
| JP | 2002-115515 | 4/2002 |
| JP | 2006-22776 | 1/2006 |

* cited by examiner

*Primary Examiner*—John Bastianelli
(74) *Attorney, Agent, or Firm*—Oblon, Spivak, McClelland, Maier & Neustadt, P.C.

(57) ABSTRACT

The electromagnet includes a valve-opening side coil portion supplied with a current to thereby generate a first magnetic flux and generate electromagnetic force in a direction moving the valve-opening side moving element toward a valve-opening position, and a valve-closing side coil portion supplied with a current to thereby generate a second magnetic flux and generate electromagnetic force in a direction moving the valve-closing side moving element toward the valve-closing position. The valve-opening side coil portion and the valve-closing side coil portion are constituted of an identical connection. The electromagnet further has a sub-coil constituted of a separate connection from the valve-opening side coil portion and the valve-closing side coil portion. By the current supply to the sub-coil, a third magnetic flux reducing at least one of the first magnetic flux and the second magnetic flux is generated.

4 Claims, 3 Drawing Sheets

ELECTROMAGNETICALLY DRIVEN VALVE

This nonprovisional application is based on Japanese Patent Application No. 2005-161610 filed with the Japan Patent Office on Jun. 1, 2005, the entire contents of which are hereby incorporated by reference.

BACKGROUND OF THE INVENTION

1. Field of the Invention

The present invention generally relates to an electromagnetically driven valve, and more particularly to an electromagnetically driven valve wherein a coil for lifting an intake/exhaust valve in a valve-opening direction and a coil for lifting the same in a valve-closing direction are constituted of an identical connection.

2. Description of the Background Art

As to a conventional electromagnetically driven valve, for example Japanese Patent Laying-Open No. 2002-115515 discloses an actuator for an electromagnetically driven valve having an object of facilitating mounting on a vehicle and to reduce weight and costs (Patent Document 1). The actuator for an electromagnetically driven valve disclosed in Patent Document 1 implements an intake valve and an exhaust valve of an engine. The actuator for an electromagnetically driven valve includes one electromagnet and two moving elements arranged above and below the electromagnet, respectively, to cause reciprocating motion of the valve element between a fully open position and a fully closed position. To the moving elements, elastic force of a plurality of springs is applied, whereby the valve element is biased to a neutral position, which is slightly shifted from an intermediate position between the fully open position and the fully closed position toward the opening direction or the closing direction.

Japanese Patent Laying-Open No. 05-018220 discloses an electromagnetically driven valve having an object of attaining sufficient driving force even when the stroke of the valve is long (Patent Document 2).

In the actuator for an electromagnetically driven valve disclosed in Patent Document 1, in an initial drive mode, one of the two moving elements is positioned so that it is nearer to the electromagnet than the other is. Accordingly, when the electromagnet is electrically supplied, a difference arises between electromagnetic force applied to one of the moving elements and that applied to the other, whereby the moving elements are drawn toward one end of the electromagnet.

However, since the difference between the electromagnetic forces respectively applied to the two moving elements is small, the driving force sufficient for moving the valve element to the fully open position or to the fully closed position cannot be attained. Therefore, in Patent Document 1, the electric supply is shut off so as to allow free oscillation of the moving elements using the stored energy of the springs. By repetition of intermittent electric supply, the amplitude of the moving elements is gradually increased, so that the valve element ultimately shifts to the fully open position or the fully closed position. In this case, it takes time until the moving elements are moved from the neutral position to the fully open position or the fully closed position.

SUMMARY OF THE INVENTION

An object of the present invention is to solve the aforementioned problem, and to provide an electromagnetically driven valve with which sufficiently great driving force can be attained in an initial drive mode.

An electromagnetically driven valve according to the present invention includes: an intake/exhaust valve associated with an internal combustion engine; a moving element made of a magnetic substance and coupled to the intake/exhaust valve to move between a valve-opening position and a valve-closing position; and an electromagnet. The electromagnet has a first coil supplied with a current to thereby generate a first magnetic flux and generate electromagnetic force in a direction moving the moving element toward the valve-opening position, and a second coil supplied with a current to thereby generate a second magnetic flux and generate electromagnetic force in a direction moving the moving element toward the valve-closing position. The first coil and the second coil are constituted of an identical connection. The moving element is held in an intermediate position between the valve-opening position and the valve-closing position in a state where electromagnetic force is not applied. The electromagnet further has a third coil constituted of a separate connection from the connection constituting the first and second coils. The third coil is supplied with a current to thereby generate a third magnetic flux reducing at least one of the first magnetic flux and the second magnetic flux.

It is noted that the intermediate position between the valve-opening position and the valve-closing position refers to the central position relative to the valve-opening position and the valve-closing position, where a distance from the valve-opening position and a distance from the valve-closing position are equal to each other.

In the electromagnetically driven valve thus configured, the first and second coils are constituted of an identical connection. Accordingly, in an initial drive mode, when the first and second coils are supplied with a current, electromagnetic force in a direction moving the moving element toward the valve-opening position and electromagnetic force in a direction moving the moving element toward the valve-closing position are simultaneously applied to the moving element. Here, supplied with a current, the third coil generates a third magnetic flux, which reduces one of the first magnetic flux and the second magnetic flux. Thus, the electromagnetic force generated by the coil of which magnetic flux is reduced becomes smaller. Since the magnetic flux being affected by the third magnetic flux is reduced, saturation of the magnetic fluxes does not occur. Thus, a difference between the electromagnetic force in the direction moving the moving element toward the valve-opening position and the electromagnetic force in the direction moving the moving element toward the valve-closing position can be ensured, and sufficient driving force for the initial drive mode of the intake/exhaust valve can be attained. Therefore, according to the present invention, the intake/exhaust valve can be shifted in a short period from the intermediate position to the valve-opening position or the valve-closing position.

Preferably, the third magnetic flux increases the other of the first magnetic flux and the second magnetic flux. With the electromagnetically driven valve thus configured, the difference between the electromagnetic force generated by the coil of which magnetic flux is reduced by the third magnetic flux and the electromagnetic force generated by the coil of which magnetic flux is increased becomes further greater. Thus, further greater driving force in the initial drive mode can be attained.

Preferably, the third coil is supplied with a current only in the initial drive mode of the internal combustion engine.

With the electromagnetically driven valve thus configured, by supplying the third coil with a current only in the initial drive mode where great driving force is required, unnecessary power consumption in the normal driving mode after the internal combustion engine is started can be prevented.

The moving element has a support portion rotatably supported, and oscillates between the valve-opening position and the valve-closing position about the support portion as a fulcrum. The moving element is provided in a plurality of numbers with a distance from each other. The electromagnet is arranged between the plurality of moving elements. With the electromagnetically driven valve of rotary drive type employing such a parallel link mechanism also, one of the aforementioned effects can similarly be attained.

As described above, according to the present invention, the electromagnetically driven valve with which sufficiently great driving force can be attained in the initial drive mode can be provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
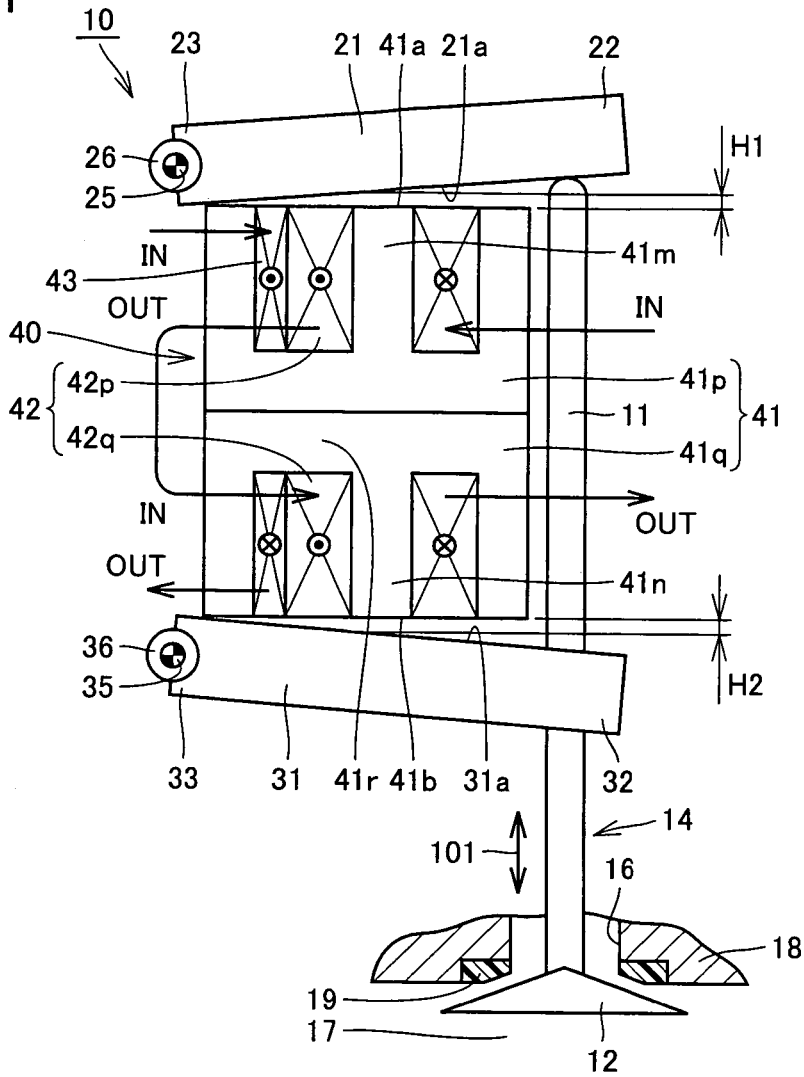
FIG. 1 is a cross-sectional view showing an electromagnetically driven valve in a first embodiment of the present invention.

Embodiments of the present invention are described with reference to the drawings. In the drawings referred to hereinafter, the same reference characters are allotted to the same or corresponding members.

First Embodiment

FIG. 1 shows an electromagnetically driven valve according to a first embodiment of the present invention. The electromagnetically driven valve according to the present embodiment implements an engine valve (an intake valve or an exhaust valve) in an internal combustion engine such as a gasoline engine or a diesel engine. In the present embodiment, description will be given assuming that the electromagnetically driven valve implements an exhaust valve, however, the electromagnetically driven valve is similarly structured also when it implements an intake valve.

Referring to FIG. 1, an electromagnetically driven valve 10 is a rotary drive type electromagnetically driven valve, driven by cooperation of magnetic force and elastic force. As a motion mechanism for the electromagnetically driven valve, a parallel link mechanism is adopted.

Electromagnetically driven valve 10 includes a driven valve 14, a valve-opening side moving element 21 and a valve-closing side moving element 31 arranged with a distance from each other to oscillate by electromagnetic force and elastic force applied thereto, an electromagnet 40 arranged between valve-opening side moving element 21 and valve-closing side moving element 31 to generate the electromagnetic force to be applied to the moving elements, and torsion bars 26 and 36 provided to valve-opening side moving element 21 and valve-closing side moving element 31 for applying the elastic force to the moving elements, respectively.

Driven valve 14 is constituted of a stem 11 extending in one direction and an umbrella-shaped portion 12 formed at an end of stem 11. Around stem 11, a not-shown valve guide is provided. By the valve guide, stem 11 is guided to be slidable in the direction in which stem 11 extends. Driven valve 14 carries out reciprocating motion in the direction in which stem 11 extends, that is, in a direction shown with an arrow 101, upon receiving the oscillating movement of valve-opening side moving element 21 and valve-closing side moving element 31.

Driven valve 14 is mounted on a cylinder head 18 having an exhaust port 16 formed. A valve seat 19 is provided in a position where exhaust port 16 of cylinder head 18 communicates to a combustion chamber 17. The reciprocating motion of driven valve 14 causes umbrella-shaped portion 12 to intimately contact with valve seat 19 or to move away from valve seat 19, so as to open or close exhaust port 16.

Valve-opening side moving element 21 and valve-closing side moving element 31 are formed from a magnetic material. Valve-opening side moving element 21 has a support portion 23 and a coupling portion 22, and extends from support portion 23 to coupling portion 22. Between support portion 23 and coupling portion 22, a surface 21*a* spreading in a substantially rectangular shape is formed. At support portion 23, a central axis 25 to be the center of the oscillating movement of valve-opening side moving element 21 is defined. To support portion 23, torsion bar 26 extending along central axis 25 is connected. Support portion 23 is rotatably supported on a not-shown disc base via torsion bar 26. At coupling portion 22, an end of stem 11 opposite to the end where umbrella-shaped portion 12 is formed is in abutment on surface 21 a.

Valve-closing side moving element 31 has a support portion 33, a coupling portion 32 and a surface 31*a*, corresponding to support portion 23, coupling portion 22 and surface 21*a* of valve-opening side moving element 21. Surface 21*a* and surface 31*a* are facing each other with a distance between them. Coupling portion 32 is rotatably coupled to an intermediate portion of stem 11 using a cam follower or the like. At support portion 33, a central axis 35 to be the center of the oscillating movement of valve-closing side moving element 31 is defined. To support portion 33, torsion bar 36 extending along central axis 35 is connected.

Torsion bar 26 applies elastic force to valve-opening side moving element 21, in a manner biasing the same clockwise around central axis 25. Torsion bar 36 applies elastic force to valve-closing side moving element 31, in a manner biasing the same counterclockwise around central axis 35. In a state where the electromagnetic force from electromagnet 40 is not applied, valve-opening side moving element 21 and valve-closing side moving element 31 are positioned by elastic force of torsion bars 26 and 36 at a position intermediate between a valve-opening position and a valve-closing position.

Between valve-opening side moving element 21 and valve-closing side moving element 31, electromagnet 40 is provided as fixed to a not-shown disc base. Electromagnet 40 is constituted of a coil 42 and a sub-coil 43, and a core portion 41 around which coil 42 and sub-coil 43 are wound. Core portion 41 is formed from a magnetic material, and for example formed of a plurality of electromagnetic steel plates as stacked.

Core portion 41 is formed by a combination of a valve-opening side core portion 41*p* positioned facing valve-opening side moving element 21 and a valve-closing side core portion 41*q* positioned facing valve-closing side moving element 31. Valve-opening side core portion 41*p* and valve-closing side core portion 41*q* are formed vertically symmetrically relative to a plane extending in an intermediate position between central axis 25 and central axis 35. Valve-opening side core portion 41*p* has an attraction surface 41*a* facing surface 21*a* of valve-opening side moving element 21, and valve-closing side core portion 41*q* has an attraction surface 41*b* facing surface 31*a* of valve-closing side moving element 31.

In a state where valve-opening side moving element 21 and valve-closing side moving element 31 are held in the intermediate position by elastic force of torsion bars 26 and 36, a space H1 between surface 21*a* and attraction surface 41*a* is equal to a space H2 between surface 31*a* and attraction surface 41*b*. When valve-opening side moving element 21 is attracted to attraction surface 41*a* by electromagnetic force of electromagnet 40, driven valve 14 is positioned in the valve-opening position. When valve-closing side moving element 31 is attracted to attraction surface 41*b* by electromagnetic force of electromagnet 40, driven valve 14 is positioned in the valve-closing position.

Core portion 41 has a shaft portion 41*m* positioned in valve-opening side core portion 41*p* and extending in parallel with stem 11, and a shaft portion 41*n* positioned in valve-closing side core portion 41*q* and extending in parallel with stem 11. Coil 42 is firstly wound around shaft portion 41*m* and then wound around shaft portion 41*n*, and constituted of a valve-opening side coil portion 42*p* wrapping around shaft portion 41*m* and a valve-closing side coil portion 42*q* wrapping around shaft portion 41*n*. The number of turns of coil 42 in valve-opening side coil portion 42*p* is equal to that in valve-closing side coil portion 42*q*.

Core portion 41 further has a shaft portion 41*r* extending perpendicularly to stem 11 at a position where valve-opening side core portion 41*p* and valve-closing side core portion 41*q* are combined. Sub-coil 43 is wound around shaft portion 41*r*. It is noted that winding method of coil 42 and sub-coil 43 is not limited thereto.

Figure 2:
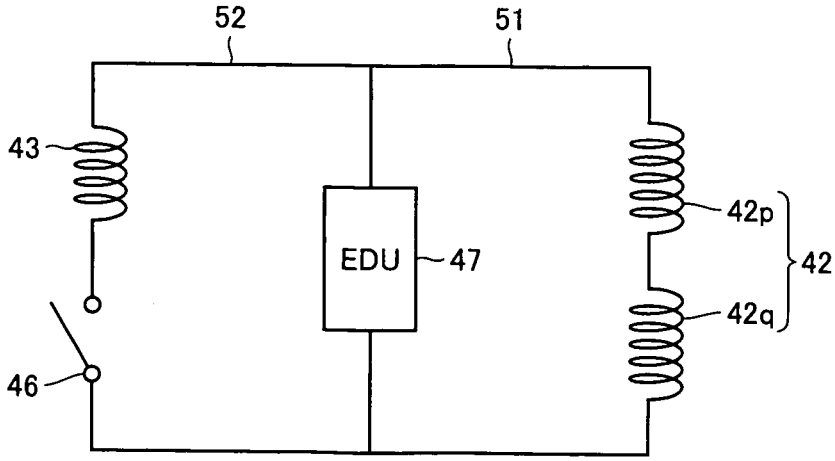
FIG. 2 shows circuitry wherein a coil and a sub-coil shown in FIG. 1 are provided.

FIG. 2 shows circuitry wherein the coil and the sub-coil shown in FIG. 1 are provided. Referring to FIGS. 1 and 2, valve-opening side coil portion 42*p* and valve-closing side coil portion 42*q* are constituted of an identical connection, and provided on a circuit 51 including an EDU (electronic driver unit) 47 to form a loop. Sub-coil 43 is constituted of a separate connection from valve-opening side coil portion 42*p* and valve-closing side coil portion 42*q*, and provided on a circuit 52 that includes EDU 27, branch from circuit 51 and form a loop. On a route of circuit 52, a switch 46 is further provided.

With such a configuration, valve-opening side coil portion 42*p* and valve-closing side coil portion 42*q* are each supplied with a current from EDU 47 in the same magnitude and at the same timing. On the other hand, in sub-coil 43, the current supply can be stopped by turning off switch 46 even when valve-opening side coil portion 42*p* and valve-closing side coil portion 42*q* are supplied with the current. That is, coil 42 and sub-coil 43 are provided so that their current supply can be controlled independently of each other. In the present embodiment, since coil 42 and sub-coil 43 are connected to single EDU 47, it is not necessary to provide an additional EDU for the provision of sub-coil 43.

Figure 3:
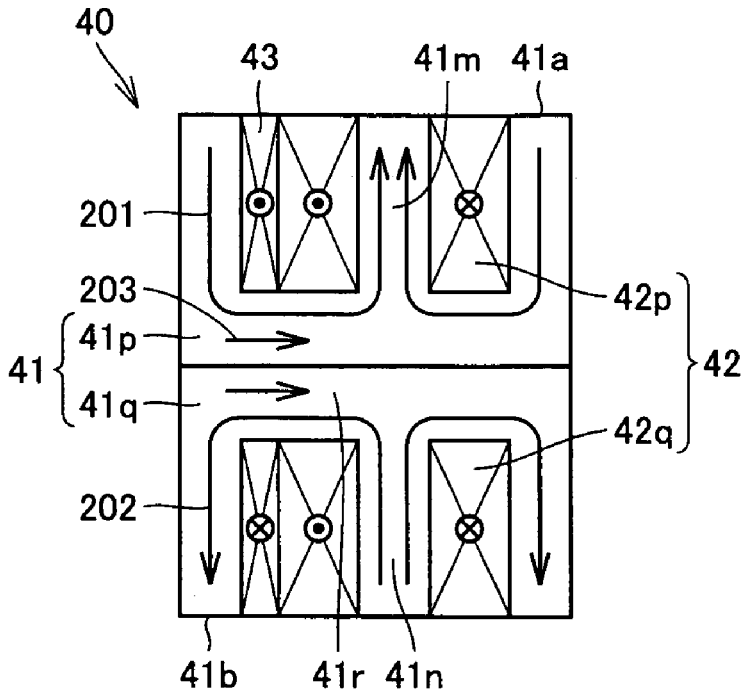
FIG. 3 is a cross-sectional view showing flow of magnetic flux in an initial drive mode of the electromagnetically driven valve shown in FIG. 1.

FIG. 3 shows flow of magnetic flux in an initial drive mode of the electromagnetically driven valve shown in FIG. 1. Referring to FIG. 3, when coil 42 is supplied with a current, by the current flowing through valve-opening side coil portion 42*p*, magnetic flux flowing in the direction indicated by an arrow 201 is formed in valve-opening side core portion 41*p*, and by the current flowing through valve-closing side coil portion 42*q*, magnetic flux flowing in the direction indicated by an arrow 202 is formed in valve-closing side core portion 41*q*. Valve-opening side coil portion 42*p* and valve-closing side coil portion 42*q* are wound such that the direction of the magnetic flux flowing through valve-opening side core portion 41*p* and the direction of the magnetic flux flowing through valve-closing side core portion 41*q* are opposite at shaft portion 41*r*.

When sub-coil 43 is supplied with a current, magnetic flux flowing in the direction indicated by an arrow 203 is formed in core portion 41. In shaft portion 41*r*, the direction of flow of the magnetic flux formed by the current supply to sub-coil 43 is identical to the direction of flow of the magnetic flux formed by the current flowing through valve-opening side coil portion 42*p*, and reverse to the direction of flow of the magnetic flux formed by the current flowing through valve-closing side coil portion 42*q*.

Next, an operation of electromagnetically driven valve 10 in an initial drive mode is described. Before electromagnetically driven valve 10 is actuated, valve-opening side moving element 21 and valve-closing side moving element 31 are held in the intermediate position. In this state, switch 46 shown in FIG. 2 is closed and a current is supplied to coil 42 and sub-coil 43. Thus, magnetic circuits are formed respectively between valve-opening side core portion 41*p* and valve-opening side moving element 21 and between valve-closing side core portion 41*q* and valve-closing side moving element 31, whereby the electromagnetic force attracting valve-opening side moving element 21 toward attraction surface 41 a and the electromagnetic force attracting valve-closing side moving element 31 toward attraction surface 41*b* are simultaneously generated.

In the present embodiment, the magnetic flux (magnetic flux A) flowing through the magnetic circuit between valve-opening side core portion 41*p* and valve-opening side moving element 21 is increased by the magnetic flux (magnetic flux C) formed by the current supply to sub-coil 43, and the magnetic flux (magnetic flux B) flowing through the magnetic circuit between valve-closing side core portion 41*q* and valve-closing side moving element 31 is reduced by the magnetic flux (magnetic flux C) formed by the current supply to sub-coil 43. Here, an expression: magnetic flux A+magnetic flux C>magnetic flux B−magnetic flux C (magnetic flux A=magnetic flux B) is satisfied, wherein the electromagnetic force applied to valve-opening side moving element 21 is greater than that applied to valve-closing side moving element 31.

As a result, by the current supply to coil 42 and sub-coil 43, valve-opening side moving element 21 and valve-closing side moving element 31 start to oscillate from the intermediate position toward the valve-opening position, against the elastic force of torsion bar 36.

It is noted that the winding direction of sub-coil 43 around shaft portion 41*r* may be reverse to the direction shown in FIG. 1. In such a case, valve-opening side moving element 21 and valve-closing side moving element 31 start to oscillate from the intermediate position toward the valve-closing position in the initial drive mode.

Figure 4:
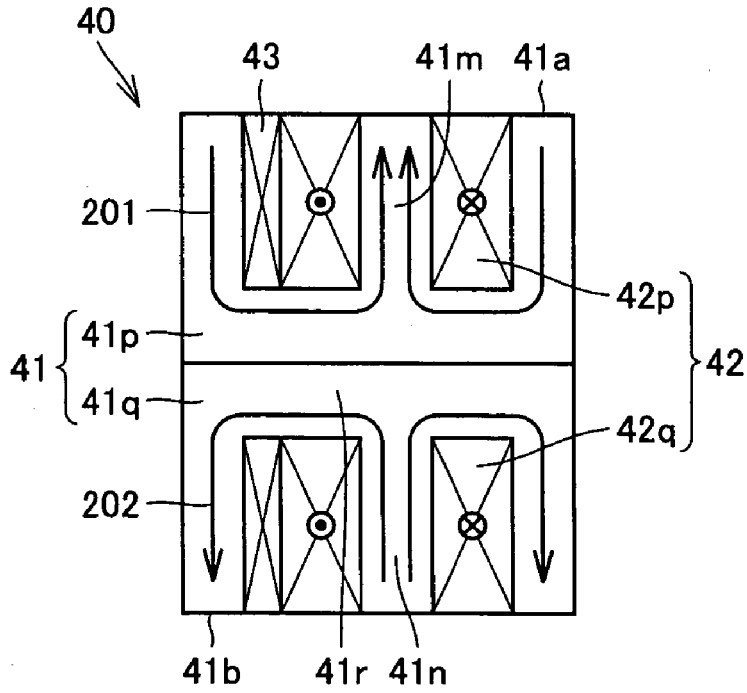
FIG. 4 is a cross-sectional view showing flow of magnetic flux in a normal drive mode of the electromagnetically driven valve shown in FIG. 1.

FIG. 4 shows flow of magnetic flux in a normal drive mode of the electromagnetically driven valve shown in FIG. 1. Referring to FIG. 4, by the current supply to coil 42 and sub-coil 43, valve-opening side moving element 21 and valve-closing side moving element 31 move to the valve-opening position. Thereafter, stopping the current supply to sub-coil 43 by turning off switch 46, and repeating the current supply start and stop to coil 42 with appropriate timing, valve-opening side moving element 21 and valve-closing side moving element 31 are cause to oscillate between the valve-opening position and the valve-closing position. Thus, in the normal drive mode of electromagnetically driven valve 10 after valve-opening side moving element 21 and valve-closing side moving element 31 are shifted from the intermediate position to the valve-opening or closing position, unnecessary power consumption at sub-coil 43 can be prevented.

Electromagnetically driven valve 10 in the first embodiment of the present invention includes driven valve 14 as an intake/exhaust valve associated with an internal combustion engine, valve-opening side moving element 21 and valve-closing side moving element 31 made of a magnetic substance and coupled to driven valve 14 to move between a valve-opening position and a valve-closing position, and electromagnet 40. Electromagnet 40 includes valve-opening side coil portion 42*p* as a first coil supplied with a current to thereby generate a first magnetic flux and generate electromagnetic force in the direction moving valve-opening side moving element 21 toward the valve-opening position, and valve-closing side coil portion 42*q* as a second coil supplied with a current to thereby generate a second magnetic flux and generate electromagnetic force in the direction moving valve-closing side moving element 31 toward the valve-closing position. Valve-opening side coil portion 42*p* and valve-closing side coil portion 42*q* are constituted of an identical connection.

Valve-opening side moving element 21 and valve-closing side moving element 31 are held in an intermediate position between the valve-opening position and the valve-closing position in a state where electromagnetic force is not applied. Electromagnet 40 further has sub-coil 43 as a third coil constituted of a separate connection from valve-opening side coil portion 42*p* and valve-closing side coil portion 42*q*. By the current supply to sub-coil 43, a third magnetic flux reducing at least one of the first magnetic flux and the second magnetic flux is generated.

With electromagnetically driven valve 10 in the first embodiment of the present invention thus constituted, by appropriately controlling the value of a current supplied to sub-coil 43, in the initial drive mode, the balance between the electromagnetic force applied to valve-opening side moving element 21 to move the same in the valve-opening position and the electromagnetic force applied to valve-closing side moving element 31 to move the same in the valve-closing position can more positively be upset. Thus, full driving force can be attained in the initial drive mode, and valve-opening side moving element 21 and valve-closing side moving element 31 can be moved to the valve-opening position or the valve-closing position in a shorter period. Thus, in the internal combustion engine incorporating electromagnetically driven valve 10, desired engine performance can be achieved from the initial drive mode.

Second Embodiment

Figure 5:
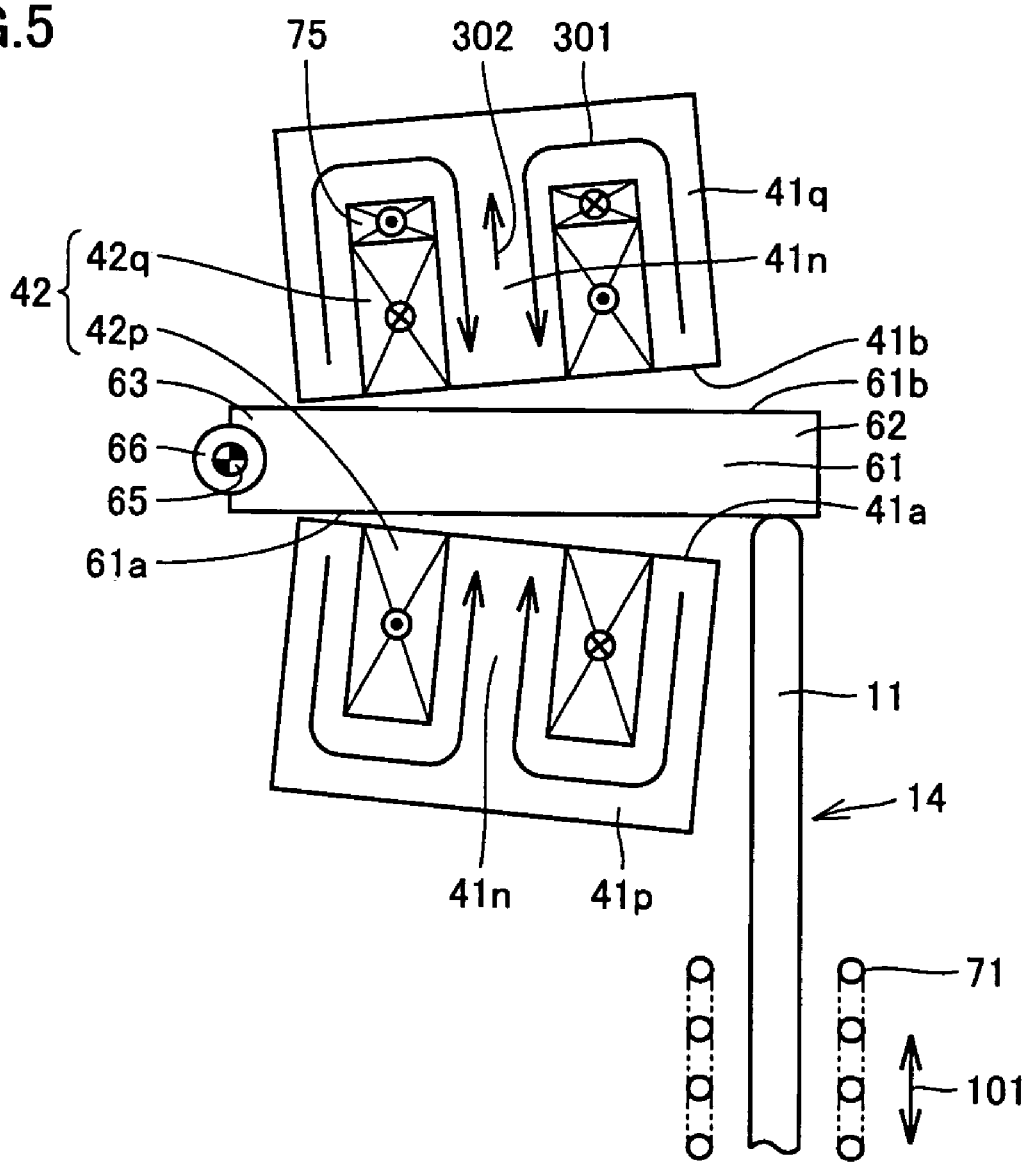
FIG. 5 is a cross-sectional view showing an electromagnetically driven valve in a second embodiment of the present invention.

FIG. 5 shows an electromagnetically driven valve in a second embodiment of the present invention. The electromagnetically driven valve in the present embodiment includes, in comparison with electromagnetically driven valve 10 in the first embodiment, partially the same structure. In the following, description of the overlapping structure will not be given.

Referring to FIG. 5, in the present embodiment, valve-opening side moving element 21 and valve-closing side moving element 31 shown in FIG. 1 are not provided, and a moving element 61 is provided instead. Moving element 61 is formed from a magnetic material, and has a support portion 63, a coupling portion 62 and a surface 61*a*, corresponding to support portion 23, coupling portion 22 and surface 21*a* of valve-opening side moving element 21 shown in FIG. 1. Moving element 61 further has a surface 61*b* opposite to surface 61*a*. At support portion 63, a central axis 65 to be the center of the oscillating movement of moving element 61 is defined. To support portion 63, torsion bar 66 extending along central axis 65 is connected.

At coupling portion 62, an end of stem 11 opposite to the end where umbrella-shaped portion 12 is formed is in abutment on surface 61*a*. On the outer circumference of stem 11, a coil spring 71 applying force to driven valve 14 to bias the same toward the valve-closing position is provided. Torsion bar 66 applies elastic force to moving element 61, in a manner biasing the same clockwise around central axis 65. In a state where the electromagnetic force from electromagnet 40 is not applied, moving element 61 is positioned by elastic force of torsion bar 66 and coil spring 71 at a position intermediate between a valve-opening position and a valve-closing position.

A valve-closing side core portion 41*q* and a valve-opening side core portion 41*p* are provided separately from each other, and arranged above and below moving element 61, respectively. An attraction surface 41*b* of valve-closing side core portion 41*q* faces surface 61*b* of moving element 61, and attraction surface 41*a* of valve-opening side core portion 41*p* faces surface 61*a* of moving element 61. When moving element 61 is attracted to attraction surface 41*a* by electromagnetic force of electromagnet 40, driven valve 14 is positioned in the valve-opening position. When moving element 61 is attracted to attraction surface 41*b* by electromagnetic force of electromagnet 40, driven valve 14 is positioned in the valve-closing position.

In the present embodiment, in place of sub-coil 43 shown in FIG. 1, a sub-coil 75 is provided. Sub-coil 75 is wound around a shaft portion 41*n* of valve-closing side core portion 41*q*, in the direction reverse to valve-closing side coil portion 42*q*.

When coil 42 is supplied with a current, by the current flowing through valve-closing side coil portion 42*q*, magnetic flux flowing in the direction indicated by an arrow 301 is formed in valve-closing side core portion 41*q*. When sub-coil 75 is supplied with a current, magnetic flux flowing in the direction indicated by an arrow 302 is formed in valve-closing side core portion 41*q*. In shaft portion 41*n*, the direction of flow of the magnetic flux formed by the current supply to sub-coil 75 is reverse to the direction of flow of the magnetic flux formed by a current flowing through valve-closing side coil portion 42*q*.

With such a configuration, in the initial drive mode, when a current is supplied to coil 42 and sub-coil 75, the magnetic flux flowing through a magnetic circuit between valve-closing side core portion 41*q* and moving element 61 is reduced by the magnetic flux formed by the current supply to sub-coil 75. Thus, the electromagnetic force applied to moving element 61 moving the same toward the valve-opening position becomes greater than the electromagnetic force applied to moving element 61 moving the same toward the valve-closing position. As a result, by the current supply to coil 42 and sub-coil 75, moving element 61 starts to oscillate from the intermediate position toward the valve-opening position, against elastic force of coil spring 71.

With the electromagnetically driven valve in the second embodiment of the present invention thus configured, the effect similar to that described as to the first embodiment can be attained.

While the present invention has been applied to the electromagnetically driven valve of rotary drive type wherein the moving element oscillates about the support portion as a fulcrum in the first and second embodiments described above, it is not limited thereto and it is applicable to an electromagnetically driven valve of direct-acting type wherein a moving element reciprocates between a valve-opening position and a valve-closing position by application of electromagnetic force.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electromagnetically driven valve, comprising:

an intake/exhaust valve associated with an internal combustion engine;

a moving element made of a magnetic substance and coupled to said intake/exhaust valve to move between a valve-opening position and a valve-closing position; and an electromagnet having a first coil supplied with a current to thereby generate a first magnetic flux and generate electromagnetic force in a direction moving said moving element toward said valve-opening position, and a second coil supplied with a current to thereby generate a second magnetic flux and generate electromagnetic force in a direction moving said moving element toward said valve-closing position, said first coil and said second coil being constituted of an identical connection, wherein said moving element is held in an intermediate position between said valve-opening position and said valve-closing position in a state where electromagnetic force is not applied, said electromagnet further has a third coil constituted of a separate connection from said connection constituting said first and second coils, and said third coil is supplied with a current to thereby generate a third magnetic flux reducing at least one of said first magnetic flux and said second magnetic flux.

2. The electromagnetically driven valve according to claim 1, wherein said third magnetic flux increases the other of said first magnetic flux and said second magnetic flux.

3. The electromagnetically driven valve according to claim 1, wherein said third coil is supplied with a current only in an initial drive mode of said internal combustion engine.

4. The electromagnetically driven valve according to claim 1, wherein said moving element has a support portion rotatably supported, and oscillates between said valve-opening position and said valve-closing position about said support portion as a fulcrum, and said moving element is provided in a plurality of numbers with a distance from each other, said electromagnet being arranged between the plurality of said moving elements.

* * * * *